US005127218A

United States Patent [19]

Schiesser et al.

[11] Patent Number: 5,127,218

[45] Date of Patent: Jul. 7, 1992

[54] DAMPED ROTOR SPINDLE

[75] Inventors: Manfred Schiesser, Oberthulba; Edwin Hey, Elfershausen; Günter Oppel, Hammelburg; Günther Schmitt, Hammelburg; Wolfgang Schmucker, Hammelburg, all of Fed. Rep. of Germany

[73] Assignee: Fag Kugelfischer Georg Schäefer, Fed. Rep. of Germany

[21] Appl. No.: 547,281

[22] Filed: Jul. 3, 1990

[30] Foreign Application Priority Data

Jul. 22, 1989 [DE] Fed. Rep. of Germany ..... 3924373

[51] Int. Cl.[5] ..... D01H 13/00

[52] U.S. Cl. ..... 57/100; 57/406; 384/536

[58] Field of Search ..... 57/100, 58.74, 406, 57/407, 75, 348; 384/536, 504, 231, 235

[56] References Cited

U.S. PATENT DOCUMENTS

| | | | |
|---|---|---|---|
| 1,425,363 | 8/1922 | Bradley | 57/100 |
| 2,922,680 | 1/1960 | Marquis et al. | 384/536 |
| 3,428,372 | 2/1969 | Keller et al. | 384/536 |
| 3,961,829 | 6/1976 | Bowen et al. | 384/536 |
| 4,398,860 | 9/1982 | Hartmannsgruber | 57/100 |
| 4,513,566 | 4/1985 | Rajsigl et al. | 57/406 |
| 4,633,664 | 1/1987 | Mueller-Storz et al. | 57/100 X |
| 4,875,334 | 10/1989 | Rajsigl et al. | 57/100 X |
| 4,899,533 | 2/1990 | Schmitt et al. | 57/100 X |

FOREIGN PATENT DOCUMENTS

| | | | |
|---|---|---|---|
| 112498 | 11/1928 | Austria | 57/100 |
| 0069030 | 1/1983 | European Pat. Off. . | |
| 545120 | 2/1932 | Fed. Rep. of Germany . | |
| 2845933 | 4/1980 | Fed. Rep. of Germany . | |
| 3605273 | 10/1986 | Fed. Rep. of Germany . | |

*Primary Examiner*—Joseph J. Hail, III

*Attorney, Agent, or Firm*—Ostrolenk, Faber, Gerb & Soffen

[57] ABSTRACT

A textile spindle for treating textile or the like, the spindle including a shaft driven by an individual motor. The rotor of the motor is on the shaft. A double row bearing includes an inner ring on the shaft. An outer ring of the bearing is supported in the spindle housing by two axially spaced apart rubber/metal elements. Two additional elastic damping elements attach the spindle housing to a spindle bearing plate. The motor stator is supported in a motor housing attached stationary with the spindle housing.

9 Claims, 2 Drawing Sheets

DAMPED ROTOR SPINDLE

BACKGROUND OF THE INVENTION

The present invention relates to a damped rotor suspension for a textile spindle, or for the like spindle, which is driven by an individual motor, where the motor rotor is on the spindle shaft, the shaft is supported by a double row bearing and there is a damping element for supporting the spindle housing and for damping its vibration.

Textile spindles which are either directly or indirectly driven by individual motors are known. For driving an indirectly driven spindle, the motor is arranged alongside the spindle, and a toothed belt drive from the motor to the spindle transmits the torque. For driving a directly driven spindle, its shaft, which is also the spindle core, carries the motor rotor. Alignment defects must in this case be substantially eliminated. Otherwise, there is a danger of the rotor contacting the stator during operation which would cause the motor to fail prematurely.

Federal Republic of Germany Pat. No. 545 120 describes the drive of a yarn spinning/twisting spindle by an integrated motor. The motor is installed centrally between two bearings, and the bearings, in turn, are each suspended in a separate bearing bushing. The bushings are held in an elastic plate which is held in the motor housing by the motor plates and by so-called limiting rings. Defects in alignment of the two bearing bushings with respect to each other cannot be avoided because both must be machined separately upon manufacture. The large mass of the elastic plate is also not adapted to prevent sagging and a resultant increase in the vibrations of the rotor. In order to avoid this, limiting rings are provided. In addition, there are fatigue phenomena of the unframed elastic material, which may lead to the bearing bushings turning on their own. This results in early failure of the bearing and destruction of the motor.

Federal Republic of Germany No. DE 28 45 933 C2 describes a yarn twist spindle which is driven by an individual motor and in which the entire motor, including the spindle, is suspended in a damped manner in an elastic ring in the vicinity of the spindle collar on the spindle bearing plate. The lower motor plate is clamped firmly in the spindle bearing plate. In this case also, there is the danger of an increase in the vibration of the spindle. In addition, the spindles influence each other because there are always a large number of spindles on the spindle bearing plate.

European Pat. No. EP 069 030 also shows a textile spindle which is driven by an individual motor. In this case, the complete spindle, including the motor, is dampened by so-called rubber buffers on the spindle bearing plate. Similar difficulties to those mentioned in connection with Federal Republic of Germany Pat. No. 545 120 and Federal Republic of Germany No. DE 28 45 933 C2 are expected here, especially because in this case, a very long distance must be traveled from the rubber buffers to the motor.

Federal Republic of Germany No. 36 05 273 Al finally describes an open end spindle driven by a motor in which, as described in Federal Republic of Germany Pat. No. 545 120, the motor is suspended between two bearings. Damping is effected by a kind of spring ring, similar to a tolerance ring, which is arranged between the bearing outer rings and the housing. In addition to the alignment defects already mentioned, such rigid damping, although it is effected by a spring, is still not suitable for high speed bearings with a unilateral load.

Another disadvantage of this product makes the damping even less effective. In order to eliminate bearing play, the lower bearing outer ring eliminates the bearing clearance via a compression spring. The outer ring must therefore have a clearance fit and is thus axially displaceable. The damping ring therefore does not enter into action at all in this case.

SUMMARY OF THE INVENTION

The object of the present invention is to assure that in a spindle, and particularly a textile spindle, of the type described above, alignment defects do not have a disadvantageous effect on the vibration behavior, and contact between the rotor and the stator is reliably avoided.

The invention comprises a spindle for textile treatment, or the like use, which is driven by an individual motor for that spindle. The spindle includes a shaft which performs some conventional textile treatment, e.g. applying a twist. The rotor of the motor is carried on and rotates with that shaft. A double row bearing has its inner ring as the shaft and has an outer ring around it.

The textile spindle of the present invention is mounted in a high speed, double row, compact bearing. The outer ring of the bearing serves at the same time as the bearing bushing. The inner ring of the bearing is the shaft. The axial distance between the two rolling element rows of the bearing can be selected to be rather large for reasons of stability. The inner ring and thus the shaft serve at the same time to receive the rotor, which may be axially placed very near to the lower row of bearings. This results in a very short lever arm from the bearing to the rotor, which has a positive effect on the precision of alignment of the rotor.

Two compact rubber/metal damping elements are located radially between the outer ring and the spindle housing, comprise an inner steel ring, an elastomer and an outer steel ring. These two elements are applied with a force fit on the outer ring, each in the vicinity of a respective rolling element row of the bearing. The complete unit, i.e. spindle and damping elements, is then introduced into the spindle housing, also with a force fit. This produces a force locked connection between the bearing, the damping elements and the spindle housing.

The motor stator is firmly anchored in the motor housing, which is connected stationary to the spindle housing.

The entire spindle is then mounted on a spindle bearing plate, again in damping elements, and is held on that plate via a spring element by a lock nut. These damping elements prevent an increase in the vibration of the spindle since a large number of spindles are usually arranged on a spindle bearing plate.

The invention will be further explained below on the basis of examples. Other features and advantages of the present invention are explained in the following description of the invention which refers to the accompanying drawings.

DETAILED DESCRIPTION OF PREFERRED EMBODIMENTS

Figure 1:
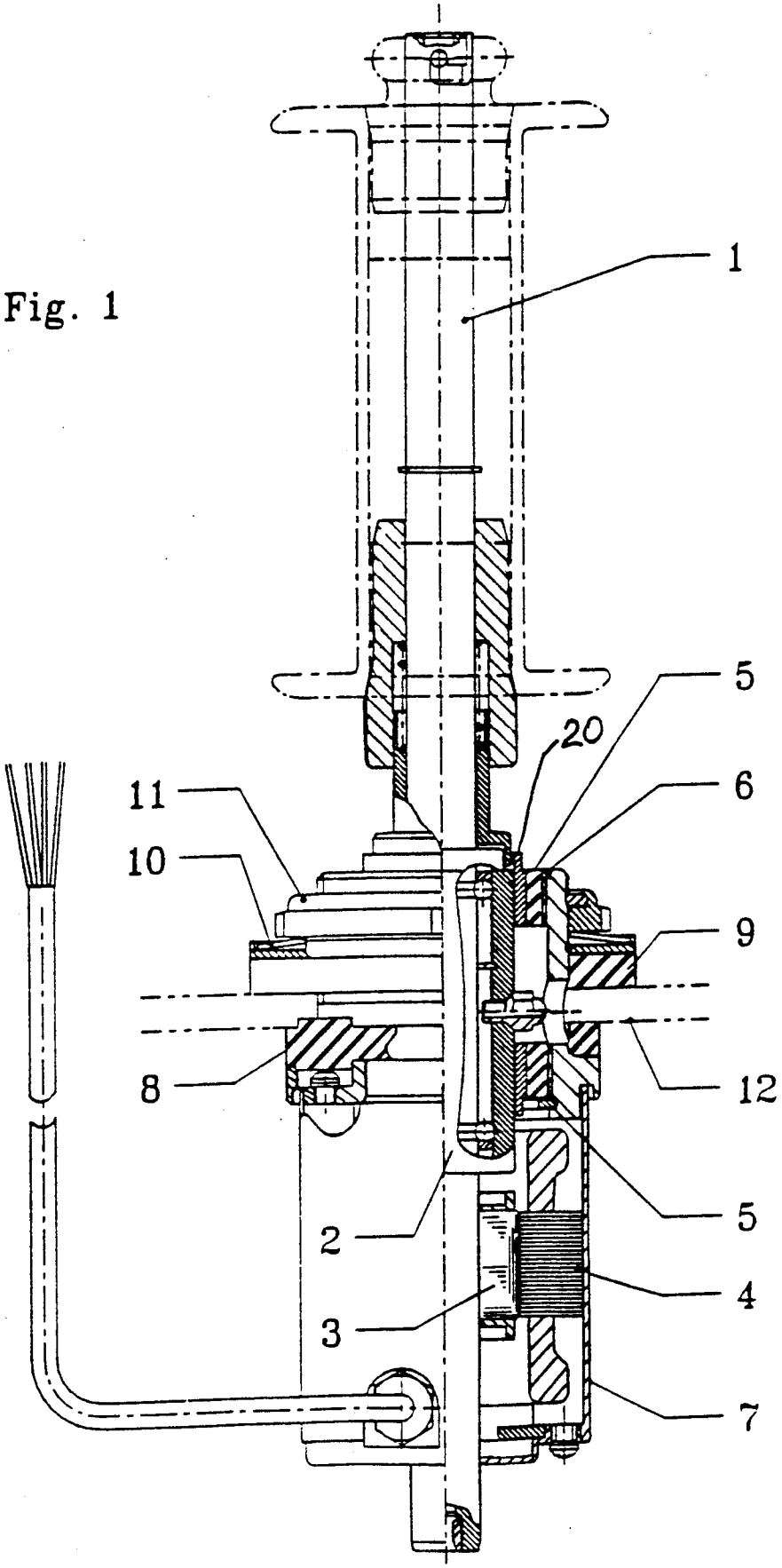
FIG. 1 is a half-sectional view of a textile spindle of the invention with a motor.

FIG. 1 shows a textile spindle of the invention. The spindle includes a shaft 1 which is mounted in a double row ball bearing 2. The shaft 1 serves as the two inner rings or races for each row of rolling elements or balls of the bearing 2, respectively. To enhance stability and reduce twisting moments, the bearing rows are preferably axially widely separated. The shaft also carries the individual motor rotor 3 around it at an axial location near to the lower row of rollers of bearing 2.

There is a unitary, rigid sleeve like outer ring 20 over both rows of bearing balls.

Two rubber/metal damping elements 5 ar arranged with a force fit over the outer ring 20 at axially spaced apart locations on the exterior of the outer ring of the bearing 2 and inside the hollow spindle housing 6. The elements 5 hold the outer ring 20 and the housing 6 apart and help damp vibration of the spindle. Each element 5 has a hardness at its rubber part in the range of Shore 60–80.

The motor stator 4 is located in the motor housing 7, which is below and is secured to the spindle housing.

The complete spindle is fastened via a cup like spring element 10 and by a lock nut 11 on the spindle bearing plate 12 between two vibration damping elements 8 and 9.

Figure 2:
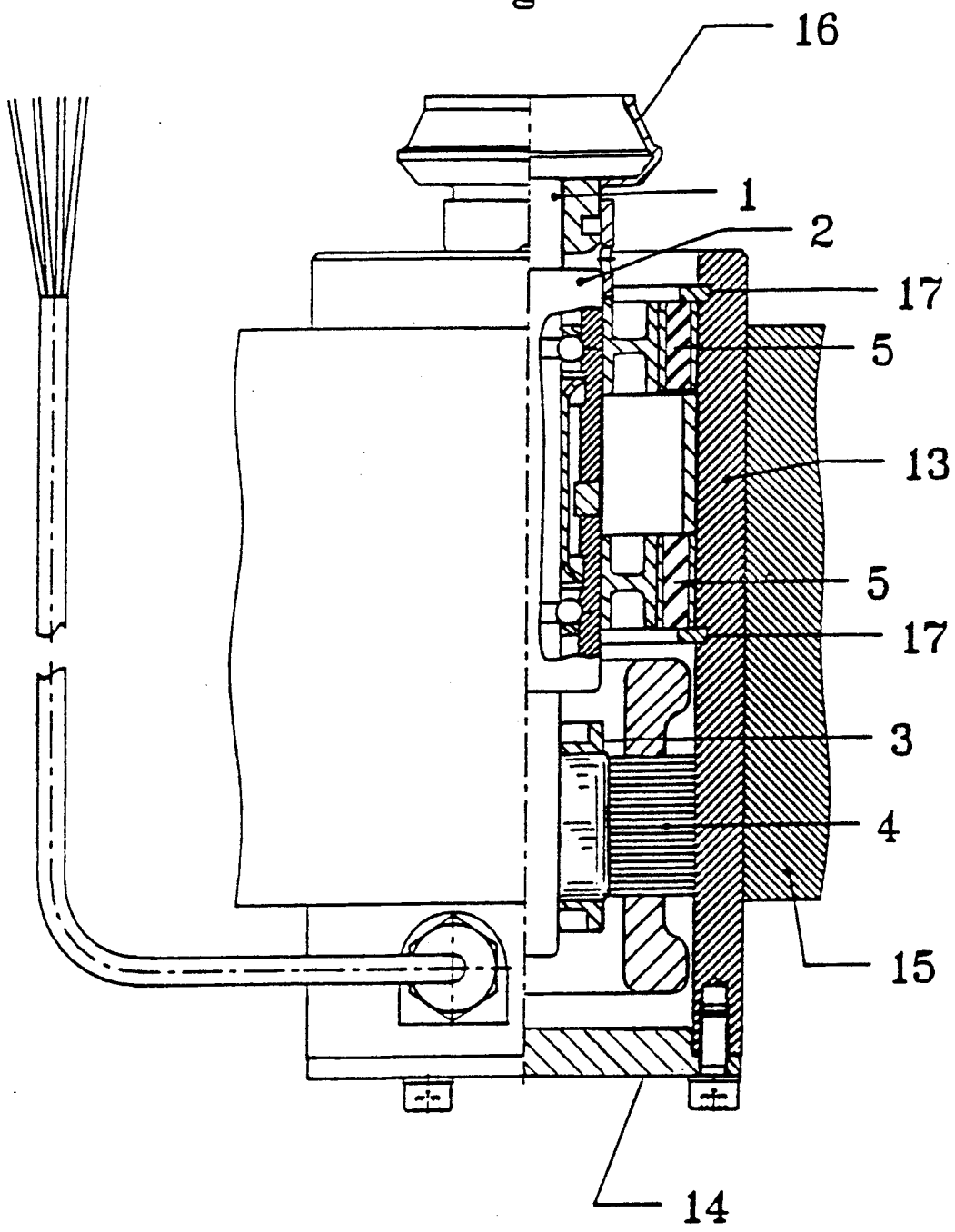
FIG. 2 shows a spindle for an open end textile machine with open end rotor and motor.

FIG. 2 shows an open end spindle for an open end spinning machine having the rotor 16. Other elements in FIG. 2 corresponding to those in FIG. 1 are correspondingly numbered. The two rubber/metal elements 5 are fastened on the double row bearing 2 and are additionally secured axially in the open ended spindle housing 13 by the retaining rings 17 above and below the elements 5. The shaft 1 carries the spindle rotor 16 in an overhung arrangement. The spindle is protected against entry of dirt and lint by the closure cap 14 at the open bottom end of the housing. The complete spindle with its housing is anchored in the open end cross bar 15 rather than to a plate, like plate 12.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A spindle for treatment of textile, or the like, and an individual motor for driving the spindle;

the spindle comprising an elongate shaft including means thereon for acting on textile material; means for shaft for defining two axially spaced apart inner races of a double row bearing; an outer ring radially outside each inner race; bearing elements disposed between each inner race on the shaft and each outer ring of the double row bearing;

a spindle housing disposed around the outer ring of the double row bearing; a respective pair of rubber/metal elements disposed at axially spaced apart locations and disposed radially between the outer ring and the spindle housing for supporting and damping vibration of the outer ring in the spindle housing;

the motor including a rotor which is carried on the shaft and rotates together with the shaft; the motor further comprising a stator supported around the rotor;

spindle bearing means comprising a spindle bearing plate; means on a housing of the motor for fastening the spindle to the spindle bearing plate vibrational damping elements between the spindle housing and the spindle bearing plate; and fastening means for fastening the spindle housing to the spindle bearing plate through the vibration damping elements.

2. The spindle and motor of claim 1, wherein the vibrational damping elements comprise an additional elastic damping element on each axial side of the spindle bearing plate, and the stationary spindle housing being supported to the spindle bearing plate through the additional elastic damping elements.

3. The spindle and motor of claim 1, wherein the portion of the spindle for acting on textile is at one axial side of the double row bearing on the shaft and the rotor and stator of the motor are at the opposite axial side of the bearing on the shaft.

4. The spindle and motor of claim 3, wherein the rotor is relatively near to one of the rows of the two row bearing, and the two rows of the bearing are spaced further apart than the rotor is spaced from the one row of the two row bearing.

5. The spindle and motor of claim 1, wherein each of the rubber/metal elements is located generally in the axial region of a respective one of the two rows of the double row bearing.

6. The spindle and motor of claim 1, wherein one of the rubber/metal elements is in the axial region of a respective one of the rows of the double row bearing and the other of the rubber/metal elements is axially spaced a short distance from the other of the rows of the double row bearing.

7. The spindle and motor of claim 1, wherein each of the rubber/metal elements is in the axial region of a respective one of the rows of the double row bearing.

8. The spindle and motor of claim 1, wherein the rubber/metal elements have a hardness in the range of 60–80 Shore.

9. The spindle and motor of claim 1, wherein the motor housing on which the motor stator is supported extends around the rotor and the shaft; the motor housing being secured to and stationary with the spindle housing.

* * * * *